US009109804B2

(12) United States Patent
Armstrong

(10) Patent No.: US 9,109,804 B2
(45) Date of Patent: Aug. 18, 2015

(54) APPLIANCE WITH VERTICALLY ADJUSTABLE RACK

(71) Applicant: General Electric Company, Schenectady, NY (US)

(72) Inventor: James Lee Armstrong, Louisville, KY (US)

(73) Assignee: General Electric Company, Schenectady, NY (US)

( * ) Notice: Subject to any disclaimer, the term of this patent is extended or adjusted under 35 U.S.C. 154(b) by 361 days.

(21) Appl. No.: 13/775,384

(22) Filed: Feb. 25, 2013

(65) Prior Publication Data

US 2014/0238383 A1 Aug. 28, 2014

(51) Int. Cl.

| | |
|---|---|
| ***F24C 15/16*** | (2006.01) |
| ***A47B 57/06*** | (2006.01) |
| ***A47B 57/08*** | (2006.01) |
| ***A47B 57/10*** | (2006.01) |

(52) U.S. Cl.

CPC ..... *F24C 15/16* (2013.01); *A47B 57/06* (2013.01); *A47B 57/08* (2013.01); *A47B 57/10* (2013.01)

(58) Field of Classification Search

CPC ..... F24C 15/16; A47B 57/06; A47B 57/08; A47B 57/10

See application file for complete search history.

(56) References Cited

U.S. PATENT DOCUMENTS

| | | | | |
|---|---|---|---|---|
| 2,641,247 | A | 6/1953 | Genebach | |
| 2,804,068 | A | 8/1957 | Miller et al. | |
| 2,834,334 | A | 5/1958 | Bill | |
| 3,834,370 | A * | 9/1974 | Nelson | 126/506 |
| 3,976,000 | A | 8/1976 | Oxel | |
| 4,766,879 | A * | 8/1988 | Freese | 126/506 |
| 5,365,860 | A | 11/1994 | Billington, III | |
| 5,564,346 | A | 10/1996 | Robben | |
| 7,147,293 | B2 | 12/2006 | Bienick et al. | |
| 7,476,186 | B1 | 1/2009 | Steffee | |

* cited by examiner

*Primary Examiner* — Alfred Basichas

(74) *Attorney, Agent, or Firm* — Dority & Manning, P.A.

(57) ABSTRACT

An appliance is provided having one or more racks or shelves the position of which may be adjusted vertically. Multiple different positions along the vertical direction can be made available for selection by a user of the appliance. The rack can also be supported from multiple locations to increase its load capacity.

18 Claims, 9 Drawing Sheets

FIG. –1–

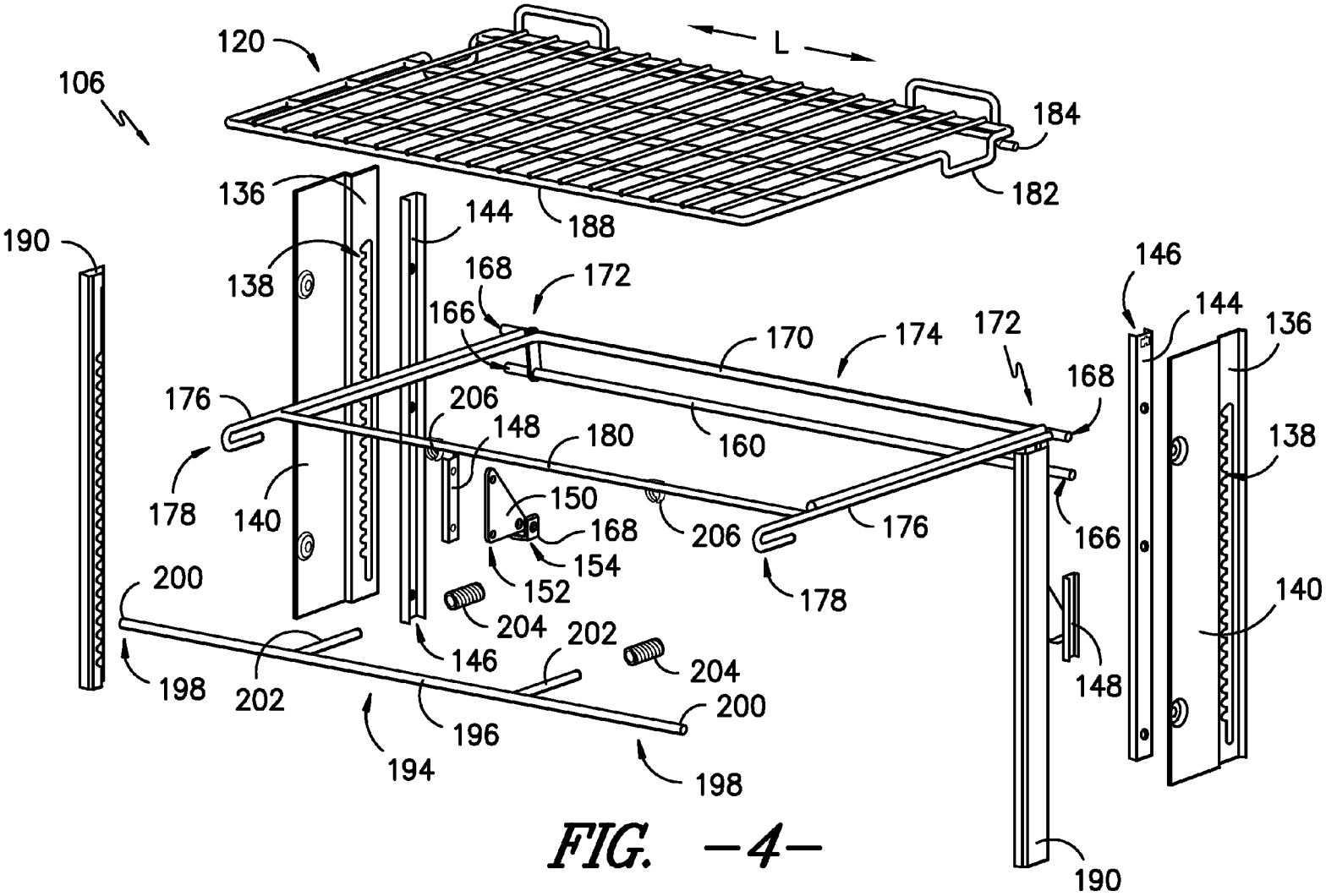
FIG. —4—

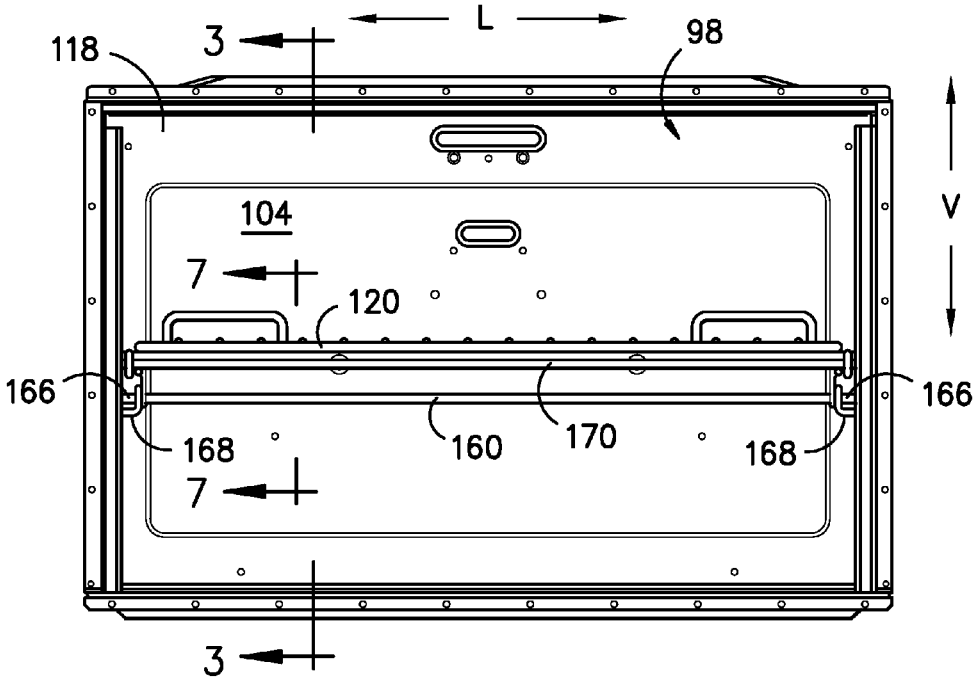
FIG. –5–
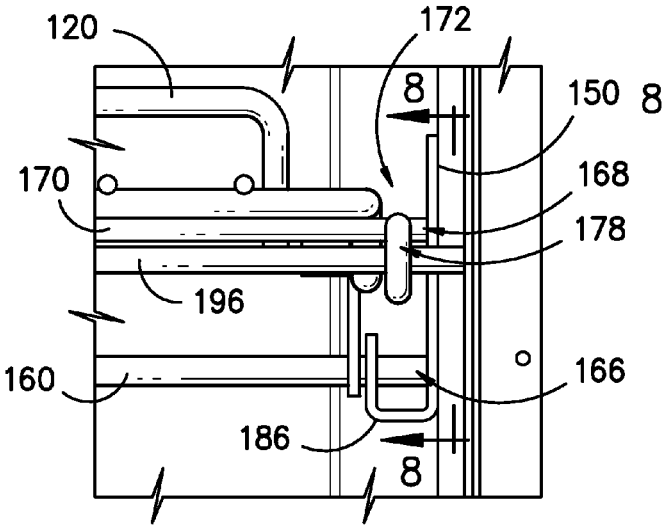
FIG. –6–

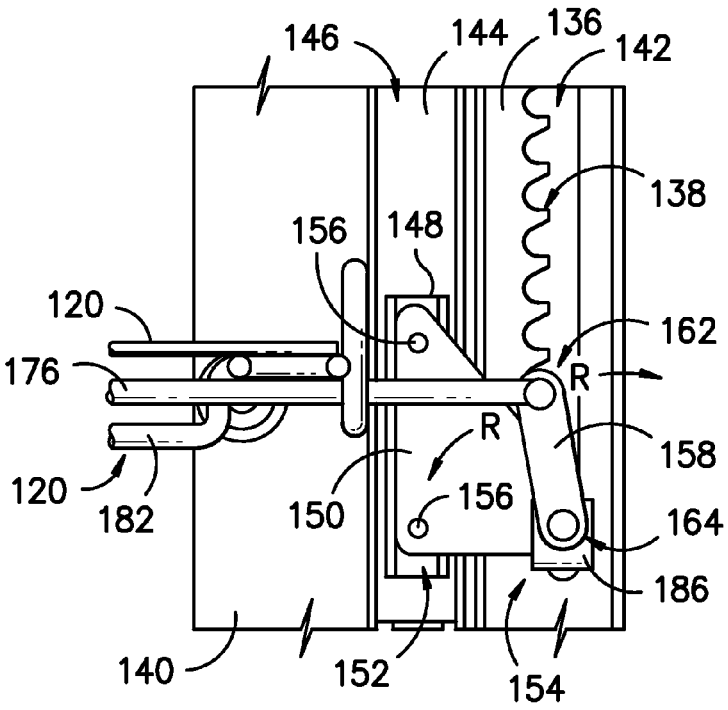
FIG. —7—
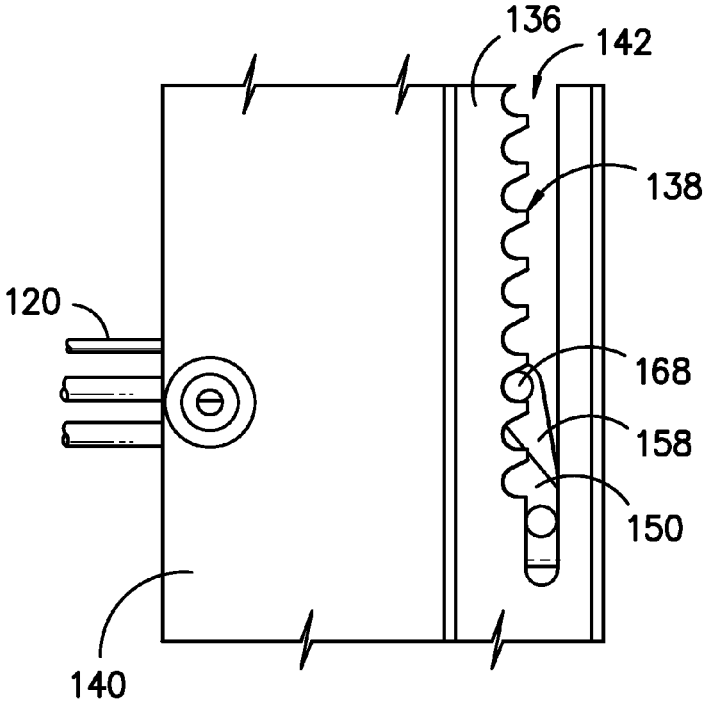
FIG. —8—

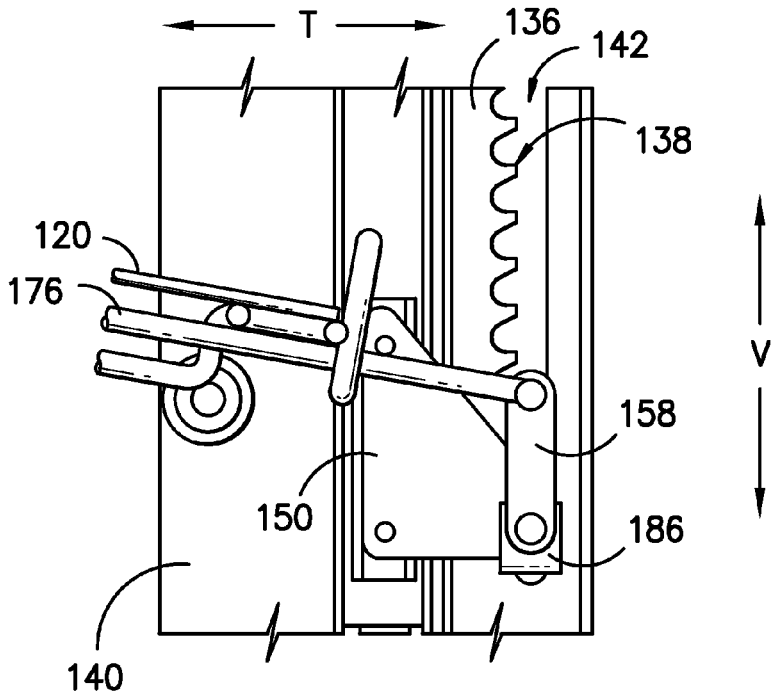
FIG. –9–
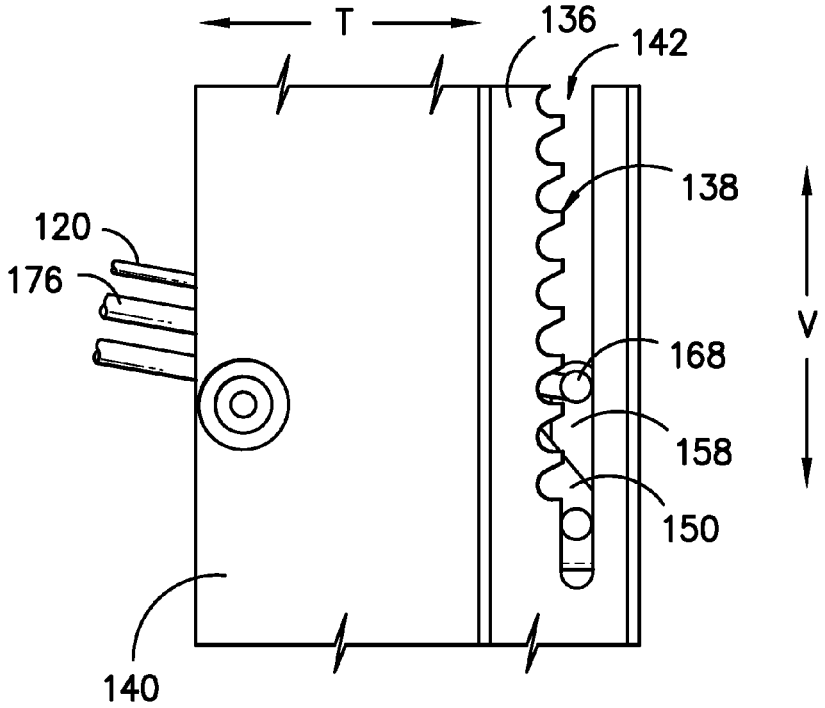
FIG. –10–

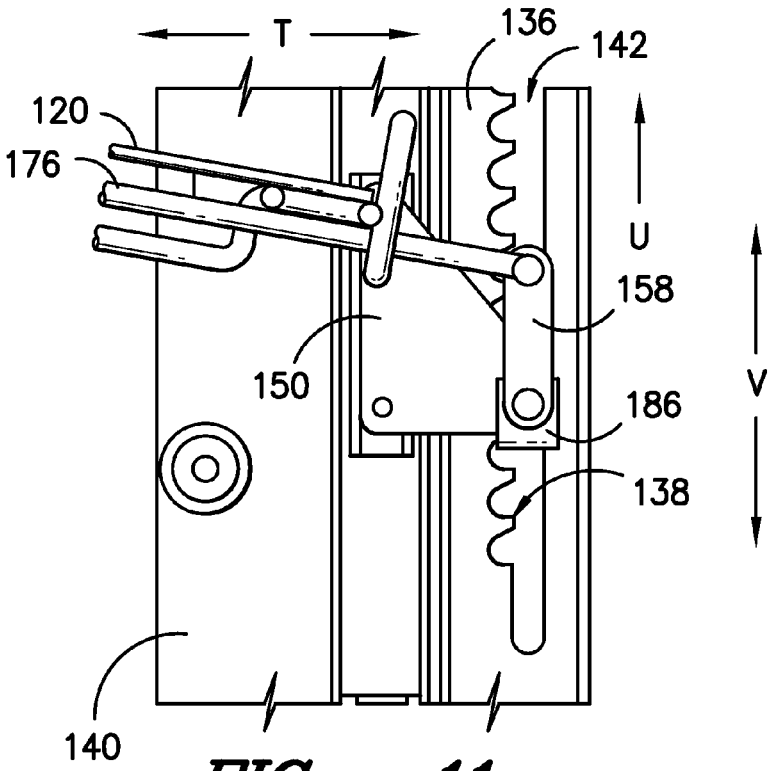
FIG. —11—
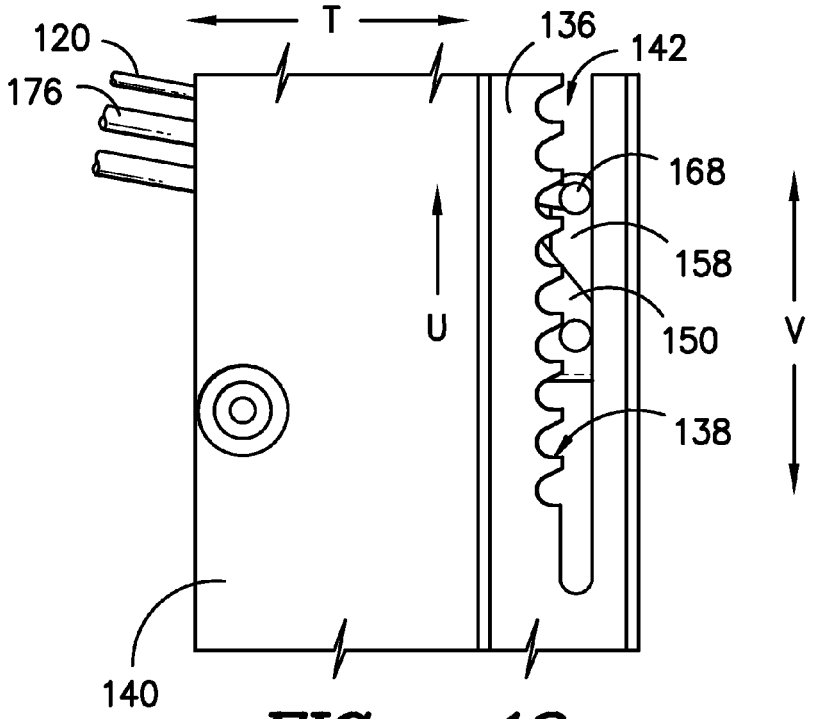
FIG. —12—

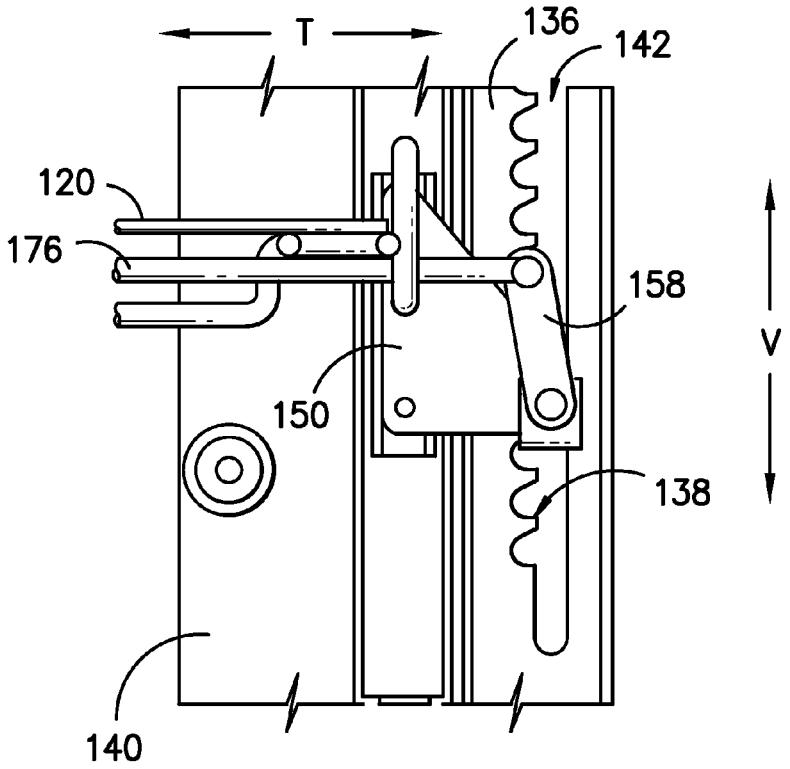
FIG. –13–
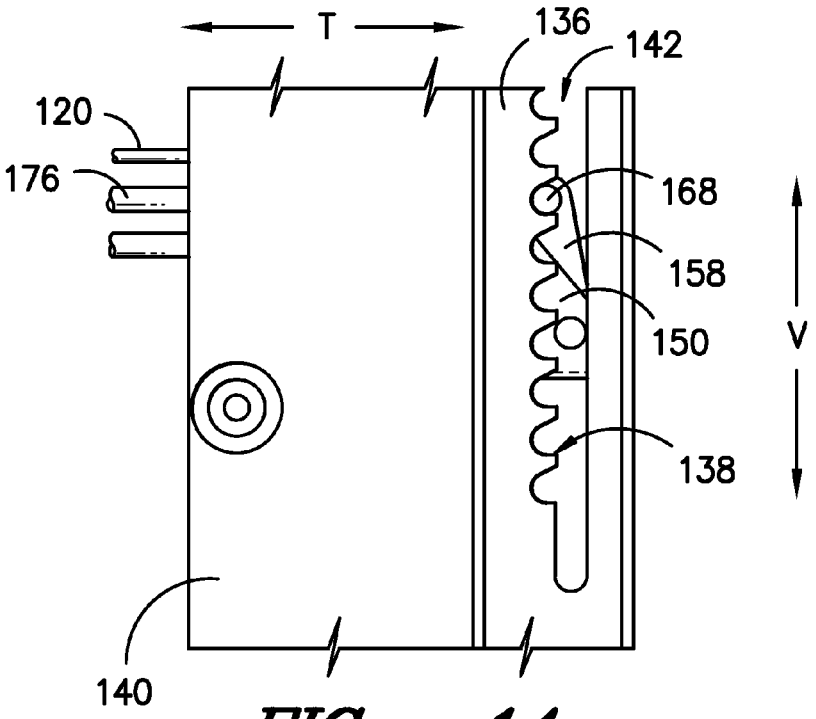
FIG. –14–

APPLIANCE WITH VERTICALLY ADJUSTABLE RACK

FIELD OF THE INVENTION

The subject matter of the present disclosure relates to an appliance with one or more features providing for the adjustability of the vertical position of a shelf or rack.

BACKGROUND OF THE INVENTION

Oven appliances conventionally include one or more racks whereby multiple food items can be placed into the oven for cooking operations. In order to accommodate food items and cooking utensils of different sizes, a typical construction includes horizontal protrusions formed directly into the side walls of the oven cavity on which the racks can be slid in and out of the oven cavity. The racks and protrusions are designed so that the user can remove the rack from the protrusions at one vertical level and reinstall the rack at a different vertical level, which the user may select based on e.g., the height of the food items or utensils, the number of items being cooked, the type of food being cooked, and/or other factors.

Such conventional design may present challenges to some users of the appliance, however. For example, some users may find the removal and reinstallation of the rack so as to adjust the vertical height to be cumbersome or difficult. Additionally, the protrusions are commonly formed by stamping metal sheets to form the side walls of the oven cavity. The number of vertical levels may be limited to e.g., only four or five within the oven cavity. Thus, the amount of vertical adjustability can be quite limited and, therefore, unsatisfactory to some users.

Other systems have been proposed to provide vertical adjustability for the racks or shelves within an appliance. Typically, however, these constructions are also limited to fixed number of a relatively few locations at which the racks or shelves can be placed within the appliance. Some constructions may also have limitations on the amount of weight that can be supported.

Accordingly, an appliance having vertically adjustable racks or shelves would be useful. An appliance also having features that allow for an increased selection of vertical locations to which the racks of shelves can be adjusted would also be useful.

BRIEF DESCRIPTION OF THE INVENTION

The present invention provides an appliance having one or more racks or shelves, the position of which may be adjusted vertically. Multiple different positions along the vertical direction can be made available for selection by a user of the appliance. The rack can also be supported from multiple locations to increase its load capacity. Additional aspects and advantages of the invention will be set forth in part in the following description, or may be apparent from the description, or may be learned through practice of the invention.

In one exemplary embodiment, the present invention provides an oven appliance that includes a cabinet defining an oven cavity for the receipt of food items for cooking, the cabinet includes a pair of opposing side walls, a rear wall, and an opening for accessing the oven cavity. A pair of primary rack gears are provided with each primary rack gear positioned adjacent one of the opposing side walls and extending along a vertical direction. Each primary rack gear includes a plurality of gear teeth arranged along the vertical direction. This embodiment also includes a pair of slides with each slide positioned adjacent one of the opposing side walls, proximate to one of the primary rack gears and extending along a vertical direction. A pair of runners are provided with each runner slidably received into one of the slides and configured for sliding movement along the vertical direction on the slides. A pair of positioning cars are included with each positioning car connected to one of the runners along a first side of the positioning car.

Each of the positioning cars in this exemplary embodiment includes a pivot arm carried by a second side of the car, the pivot arm rotatable relative to the second side of the car; and a primary boss extending from the pivot arm. A latch mechanism is connected with the pivot arm of one or both of the pairs of positioning cars. The latch mechanism is configured for selectively causing the pivot arm of each car to rotate relative to such car so that each primary boss can be moved between i) a first position wherein the primary boss is engaged with at least one of the plurality of teeth of one of the primary rack gears so as to fix the latch mechanism at a selected position along the vertical direction, and ii) a second position wherein the primary boss is disengaged from the plurality of teeth of one of the primary rack gears so that the latch mechanism may be moved to another selected position along the vertical direction by sliding the pair of positioning cars along the vertical direction. A rack extends between the opposing side walls with the rack supported upon the latch mechanism.

In another exemplary embodiment, the present invention provides an appliance defining lateral, vertical, and transverse directions. The appliance includes a cabinet defining a cavity and including a pair of opposing side walls and a rear wall extending laterally between the opposing side walls. A rack is located in the cavity of the cabinet. A rack support assembly is provided for positioning the rack along the vertical direction in the cavity. Along each of the opposing side walls the rack support assembly includes a rack gear comprising a plurality of teeth, the rack gear positioned adjacent to one of the opposing side walls and extending along the vertical direction; a track extending along the vertical direction and parallel to the rack gear; and a positioning car carried on the track. The positioning car includes a pivot arm having a first end and a second end and a primary boss extending from the first end of the pivot arm. The pivot arm is rotatable about the second end between i) a first position where the primary boss rests upon the plurality of teeth of one of the rack gears so as to fix the vertical position of the rack support assembly, and ii) a second position where the primary boss is removed from the plurality of teeth of one of the rack gears so that the rack support assembly can be selectively moved along the vertical direction. A latch mechanism is connected with the pivot arm. The rack is supported upon the latch mechanism.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which:

FIG. 4 is an exploded, perspective view of the exemplary embodiment of a vertically adjustable oven rack support assembly shown in FIG. 2.

FIG. 5 provides a front view of the exemplary oven cabinet and oven rack support assembly of FIGS. 2 and 3.

FIG. 6 is a close up, front view of a portion of the exemplary oven rack support assembly shown in FIG. 5.

FIGS. 7, 9, 11 and 13, are close up, side views of a portion of the exemplary oven rack support assembly shown in FIGS. 2 through 6 as taken along line 7-7. FIGS. 7, 9, 11, and 13 illustrate the movement of certain exemplary features as an oven rack is raised from one vertical position to another.

FIGS. 8, 10, 12, and 14 are close up, side views of a portion of the exemplary oven rack support assembly shown in FIGS. 2 through 6 as taken along line 8-8 in FIG. 6. FIGS. 8, 10, 12, and 14 provides a close up of the same features as FIGS. 7, 9, 11, and 13, respectively, but from an opposing side view.

DETAILED DESCRIPTION OF THE INVENTION

Figure 1:
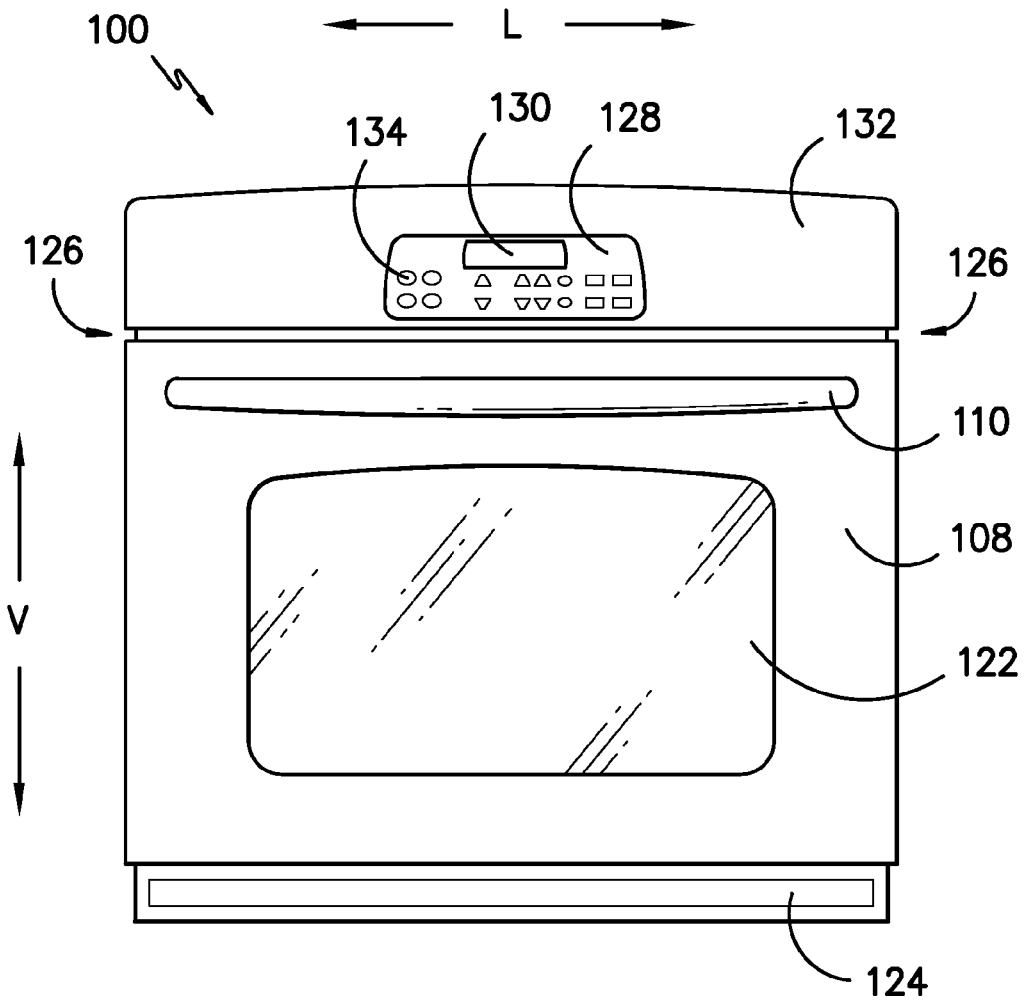
FIG. 1 is a front view of an exemplary embodiment of an oven appliance of the present invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
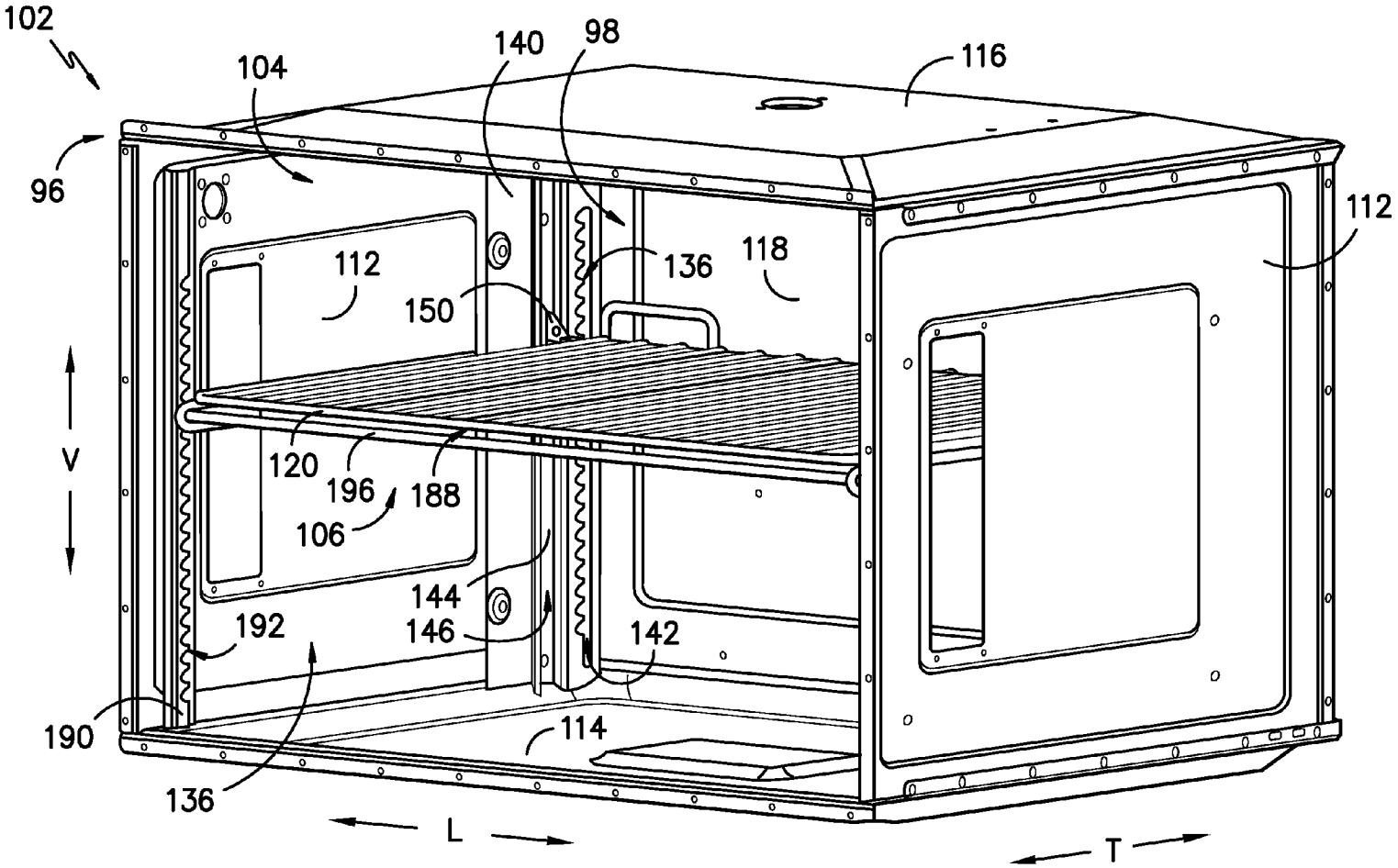
FIG. 2 is a perspective view of an exemplary appliance cabinet, as may be used in the oven of FIG. 1, shown with an oven cavity incorporating an exemplary embodiment of a vertically adjustable oven rack support assembly of the present invention.

Referring to FIG. 1, an exemplary embodiment of an oven 100 according to the present invention is shown. FIG. 1 provides a front view of oven 100 while FIG. 2 provides a partial perspective view into the cabinet 102 of oven 100, which defines an exemplary cooking chamber or cavity 104 into which a vertically adjustable oven rack (or oven shelf) support assembly 106 has been installed. As used herein, "rack" is not limited to elongated wire structures and includes shelves constructed from other materials such as expanded metal and others. Accordingly, "rack" and "shelf" (and the plural forms thereof) are used interchangeably herein.

Oven 100 includes a door 108 with handle 110 that provides for opening and closing access to oven cavity 104 through opening 98 at the front 96 of cavity 104. A user of the appliance 100 can place a variety of different items to be cooked in oven cavity 104, which is defined a pair of opposing side walls 112, bottom wall 114, top wall 116, and rear wall 118 that extends laterally between opposing side walls 112. Multiple oven shelves or racks 120 can be positioned within cavity 104 (only one rack 120 is shown) on rack support assembly 106. The support and height adjustability of rack 120 using assembly 106 will be further described.

One or more heating elements (not shown) can be positioned e.g., at the top of chamber 104 to provide heat for cooking and cleaning. Such heating element(s) can be e.g., gas, electric, microwave, or a combination thereof. Other heating elements can be located at the bottom of chamber 104 as well. A window 122 on door 108 allows the user to view e.g., food items during the cooking process. For purposes of cooling, inlet 124 allows for an inflow of ambient air into a ventilation system while vent 126 allows for the outflow of such air after it has been heated by oven 100.

Oven 100 includes a user interface 128 having a display 130 positioned on top panel 132 with a variety of controls 134. Interface 128 allows the user to select various options for the operation of oven 100 including e.g., temperature, time, and/or various cooking and cleaning cycles. Operation of oven appliance 100 can be regulated by a controller (not shown) that is operatively coupled i.e., in communication with, user interface panel 128, heating element(s), and other components of oven 100 as will be further described.

For example, in response to user manipulation of the user interface panel 128, the controller can operate one or more heating element(s). The controller can receive measurements from a temperature sensor (not shown) placed in oven cavity 104 to e.g., provide a temperature indication to the user with display 130. By way of example, the controller may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In one embodiment, the processor executes programming instructions stored in memory. The memory may be a separate component from the processor or may be included onboard within the processor.

The controller may be positioned in a variety of locations throughout appliance 100. In the illustrated embodiment, the controller may be located under or next to the user interface 128 or otherwise within top panel 132. In such an embodiment, input/output ("I/O") signals are routed between the controller and various operational components of appliance 100 such as heating element(s), controls 134, display 130, sensor(s), alarms, and/or other components as may be provided. In one embodiment, the user interface panel 128 may represent a general purpose I/O ("GPIO") device or functional block.

Although shown with touch type controls 134, it should be understood that controls 134 and the configuration of appliance 100 shown in FIG. 1 is provided by way of example only. More specifically, user interface 128 may include various input components, such as one or more of a variety of electrical, mechanical or electro-mechanical input devices including rotary dials, push buttons, and touch pads. The user interface 128 may include other display components, such as a digital or analog display device designed to provide operational feedback to a user. The user interface 128 may be in communication with the controller via one or more signal lines or shared communication busses. Also, oven 100 is shown as a wall oven but the present invention could also be used with other appliances such as e.g., a stand-alone oven, an oven with a stove-top, and non-oven appliances as well.

Referring now of FIGS. 2, 3, 4, and 5, for this exemplary embodiment, oven rack support assembly 106 includes a pair of primary rack gears 136. Each rack gear 136 is positioned adjacent to (and may be attached to) one of the opposing side walls 112, and each extends along vertical direction V. Each primary rack gear 136 includes a plurality of gear teeth 138 that are also arranged along vertical direction V and, for this exemplary embodiment, are oriented towards the adjacent rear wall 118. For this exemplary embodiment, the number and configuration of gear teeth 138 along rack gear 136 determines the amount of vertical adjustability including the number of positions at which rack 120 can be placed along vertical direction V. Other orientations and shapes for gear teeth 138 may also be used in other embodiments of the invention.

For this exemplary embodiment, each rack gear 136 is stamped and punched from a metal plate or sheet 140 and defines a vertical slot 142 adjacent to gear teeth 138. Other constructions for providing rack gears 136 with teeth 138 may be used as well such as e.g., molded or cast constructions to provide a rack gear and associated teeth. Notably, rack gear 136 extends the full height of oven cavity 104 along vertical direction V in order to maximize the amount of adjustability and usable space for one or more oven racks 120. Shorter rack gears could also be used.

A pair of slides 144 are positioned proximate to rack gears 136. Each slide 144 is located adjacent to (and may be attached to) one of the opposing side walls 112. Each slide 144 extends along vertical direction V in a manner that is parallel to a respective rack gear 136. For this exemplary embodiment, a C-shaped channel or track 146 is formed in each slide 144.

A runner 148 is slidably received into each slide 144. More specifically, each runner 148 can move vertically along a respective slide 144. In one exemplary embodiment, ball bearings (not shown) may be provided between runner 148 and slide 144 to facilitate movement of runner 148 up and down within track 146. Other constructions for runner 148 and slide 144 may be used as well.

Referring now to FIGS. 6 and 7 as well as the preceding figures, a pair of positioning cars 150 are provided with one car 150 connected to each runner 148 along a first side 152 of each car 150. First side 152 is oriented towards the front 96 of oven cavity 104. Car 150 moves with its respective runner 148 as it moves on a slide 144 along vertical direction V.

As shown in the figures, each paired runner 148 and car 150 are depicted as separate components connected by fasteners 156 for this exemplary embodiment. Using the teachings disclosed herein, one of skill in the art will understand that other construction may be used as well. For example, runner 148 and positioning car 150 may be constructed as an integral component such that positioning car 150 is carried directly onto track 146 provided by slide 144 and is slidable along vertical direction V. Other constructions may also be used.

Figure 3:
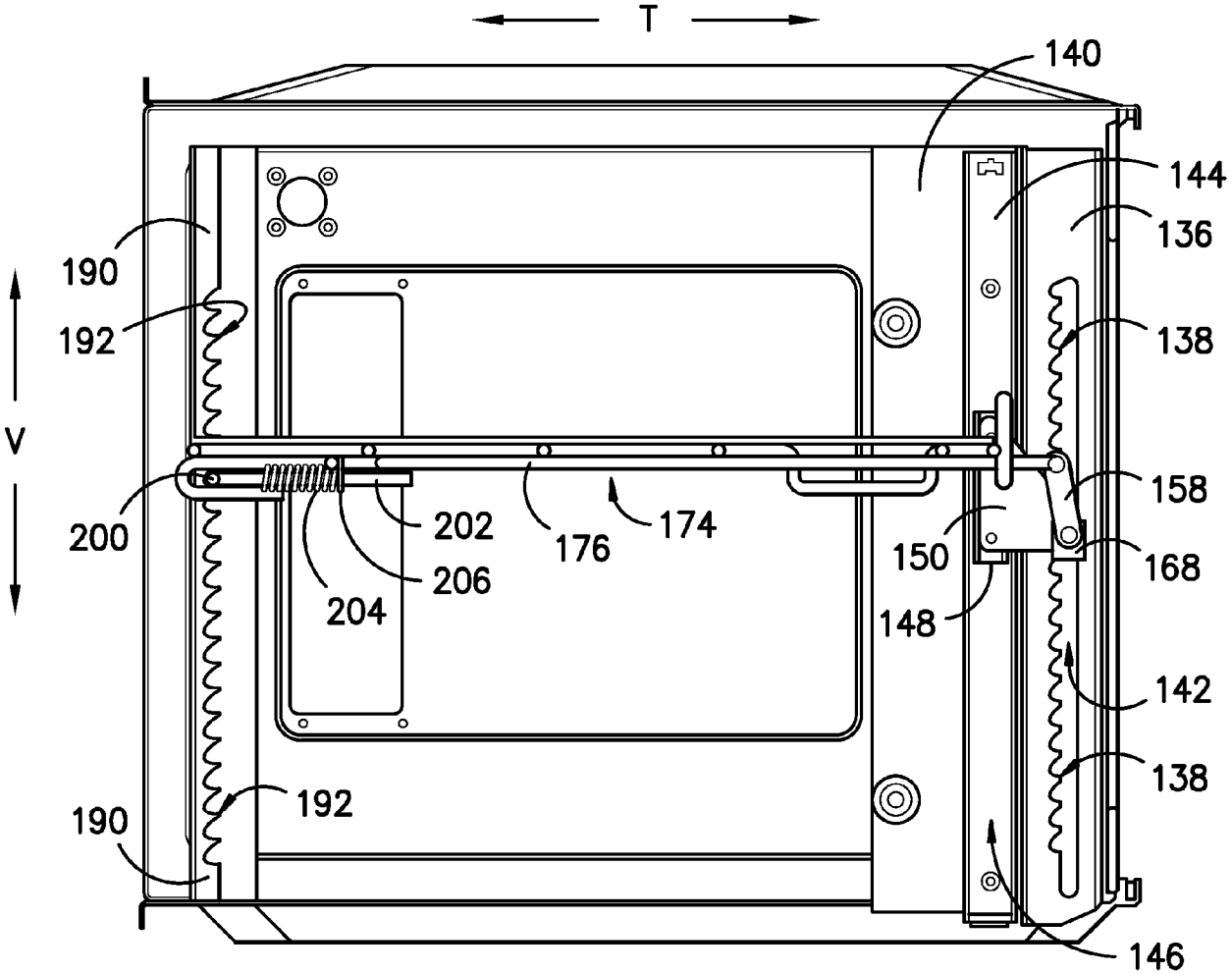
FIG. 3 is a cross-sectional view (taken along line 3-3 as shown in FIG. 5) of the exemplary appliance cabinet and support assembly of FIG. 2.

As shown in FIGS. 3, 7, and 8, each positioning car 150 includes a pivot arm 158 that is carried by the second side 154 of positioning car 150 and is rotatable relative to car 150 (arrows R in FIG. 7). More specifically, each pivot arm 158 includes a first end 162 and a second end 164 (FIG. 7). A lower elongate rod 160 extends along lateral direction L between a pair of distal ends 166 (FIG. 4). Each distal end 166 extends through the second side 154 of a respective positioning car 150 and is connected to the second end 164 of a respective pivot arm 158. Each distal end 166 also extends through a U-shaped bracket 186, connected to second side 154 of positioning car 150 to provide additional reinforcement in supporting rack 120. Pivot arm 158 is rotatable or pivotable about its second end 164 with each distal end 166 of lower elongate rod 160 serving as a pivot point.

A primary boss 168 (FIGS. 4, 6, and 8) extends from the first end 162 of each pivot arm 158. More specifically, an upper elongate rod 170 extends along lateral direction L between a pair of distal ends 172 that each define a primary boss 168. For this exemplary embodiment, distal ends 172 of upper elongate rod 170 are inserted through the first end 162 of each pivot arm 158 to create primary boss 168. Distal ends 172 of upper elongate rod 170 are welded or otherwise affixed to pivot arm 158 to prevent rotation. Other constructions may be used to provide for the primary boss 168 extending from first end 162 of each pivot arm 158, it being understood that the figures illustrate an exemplary embodiment.

As best seen in FIGS. 3 and 4, oven rack support assembly 106 includes a latch mechanism 174 upon which rack 120 is supported or positioned. Latch mechanism 174 includes lower elongate rod 160 and upper elongate rod 170, which are connected with pivot arms 158 as previously described. Latch mechanism 174 also includes a pair of struts 176 that extend along transverse direction T between rear wall 118 and front opening 98 of oven cavity 104. For this exemplary embodiment, struts 176 each include a hook or U-shaped portion 178, the function of which will be further described herein. A connecting strut 180 extends along the lateral direction between struts 176 to provide further strength for latch mechanism 174. Rack 120 is can slide along transverse direction T relative to latch mechanism 174, which may be convenient e.g., to a user placing an item for cooking onto rack 120. Stops 182 (FIG. 4) limit the amount of movement out of oven cavity 104 along transverse direction T while pins 184 prevent rack 120 from tipping when it is fully extended away from rear wall 118.

Rack 120 can be fully supported on latch mechanism 174, which is connected with the pairs of pivot arms 158 and positioning cars 150 as previously described. Once the pair of primary bosses 168 are engaged with gear teeth 138, the interaction of the positioning cars 150 with slides 144 fixes rack 120 at the desired vertical level in oven cavity 104. In a manner that will be further described, rack 120 can be repositioned by lifting the front 188 of rack 120 to disengage primary bosses 168 from teeth 138—whereupon latch mechanism 174 and rack 120 can be moved by sliding cars 150 along slides 144 to another selected position along vertical direction V.

While the present invention includes exemplary embodiments where rack 120 is supported on latch mechanism 174 by primary rack gears 136 and slides 144, additional support for rack 120 can be provided as shown in the figures. More particularly, referring to FIGS. 2, 3, and 4, oven rack support assembly 106 can also be equipped with a pair of secondary rack gears 190 positioned adjacent opposing side walls 112 (and may be connected thereto) near the front 96 of cabinet 102. Each secondary rack gear 190 includes a plurality of gear teeth 192 arranged along vertical direction V.

In order to engage gear teeth 192, latch mechanism 174 further includes an actuator 194 configured in this exemplary embodiment as elongated rod 196 extending along the lateral direction L between a pair of ends 198. Each end 198 provides a secondary boss 200 configured to engage gear teeth 192 of rack gears 190. Actuator 194 also includes a pair of guide rods 202 that extend along transverse direction T towards rear wall 118. Each guide rods 202 is each received into a respective spring 204 and then into an eyelet 206 attached to connecting strut 180. Springs 204 urge secondary bosses 200 against the U-shaped portion 178 of struts 176 and into gear teeth 192.

By depressing actuator 194 against springs 204, secondary bosses 200 can be selectively moved between i) a first position (shown in FIG. 3) where each secondary boss 200 engages the plurality of gear teeth 192 of secondary rack gear 190 to fix the vertical position of latch mechanism 174 and ii) a second position where each secondary boss 200 is disengaged from gear teeth 192 so that the vertical position of latch mechanism 174 may be moved along the vertical direction.

Accordingly, in order to reposition rack 120 as desired along the vertical direction, actuator 194 is depressed and the front 188 of rack 120 is lifted along vertical direction V. As front 188 of rack 120 is lifted, each primary boss 168 is moved from a first position shown in FIGS. 7 and 8 to a second position shown in FIGS. 9 and 10.

More specifically, FIGS. 7 and 8 illustrate a first position where primary boss 168 is engaged with gear teeth 138 of primary rack gear 136, which fixes the position of latch mechanism 174 (and, therefore, rack 120) along vertical direction V. In the second position shown in FIGS. 9 and 10, pivot arm 158 is rotated or pivoted by the lifting of front 188 of rack 120 so that primary boss 168 is disengaged from the plurality of gear teeth 138 of the primary rack gear 136.

As shown in FIGS. 11 and 12, once each primary boss 168 is disengaged into the second position, latch mechanism 174 and rack 120 may be slid in slot 142 along vertical direction V to either raise or lower rack 120 as desired. For example, as indicated by arrow U, rack 120 may be raised vertically in the direction of arrow U to a different height selected by the user depending upon e.g., the height of food items and/or utensils to be placed in oven cavity 104, the number of racks 120 the user desires to place in cavity 104, and/or other factors as well.

Once the desired vertical height is reached, the front 188 of rack 120 is lowered. As front 188 is lowered, pivot arm 158 is rotated or pivoted. As a result, as shown in FIGS. 13 and 14, primary boss 168 is reengaged with the teeth 138 of primary rack gear 136 to fix the vertical position of latch mechanism 174 and rack 120 at the selected vertical position. Actuator 194 can then be released to engage the secondary bosses 200 with the gear teeth 192 of secondary rack gears 190. Similar steps can be used to further raise rack 120 or to lower rack 120. As stated previously, because the rack gears are provided with multiple teeth, support assembly 106 provides for multiple levels of vertical adjustability.

The figures depict only one rack 120. As will be understood by one of skill in the art using the teachings disclosed herein, multiple racks 120 may be placed within cavity 104. Each rack 120 can be equipped with the oven rack support assembly 106 to provide adjustability as described herein. Racks 120 are provided by way of example only—racks or shelves of other constructions and shapes may also be used.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An oven appliance, comprising:

a cabinet defining an oven cavity for the receipt of food items for cooking, the cabinet comprising a pair of opposing side walls, a rear wall, and an opening for accessing the oven cavity;

a pair of primary rack gears, each primary rack gear positioned adjacent one of the opposing side walls and extending along a vertical direction, each primary rack gear comprising a plurality of gear teeth arranged along the vertical direction;

a pair of slides, each slide positioned adjacent one of the opposing side walls, proximate to one of the primary rack gears and extending along a vertical direction;

a pair of runners, each runner slidably received into one of the slides and configured for sliding movement along the vertical direction on the slides;

a pair of positioning cars, each positioning car connected to one of the runners along a first side of the positioning car, each of the positioning cars comprising a pivot arm carried by a second side of the car, the pivot arm rotatable relative to the second side of the car;

a primary boss extending from the pivot arm;

a latch mechanism connected with the pivot arm of one or both of the pairs of positioning cars, the latch mechanism configured for selectively causing the pivot arm of each car to rotate relative to such car so that each primary boss can be moved between a first position wherein the primary boss is engaged with at least one of the plurality of teeth of one of the primary rack gears so as to fix the latch mechanism at a selected position along the vertical direction, and a second position wherein the primary boss is disengaged from the plurality of teeth of one of the primary rack gears so that the latch mechanism may be moved to another selected position along the vertical direction by sliding the pair of positioning cars along the vertical direction; and a rack extending between the opposing side walls, the rack supported upon the latch mechanism.

2. An oven appliance as in claim 1, wherein each pivot arm comprises a first end and a second end spaced apart from each other along the pivot arm, and wherein the latch mechanism further comprises:

a lower elongate rod extending along the lateral direction between a pair of ends, wherein each end is inserted through the second side of one of the positioning cars and is connected to one of the pivot arms, each pivot arm being pivotable about its second end.

3. An oven appliance as in claim 2, wherein the latch mechanism further comprises:

an upper elongate rod extending along the lateral direction between a pair of ends with each end of the upper elongate rod defining one of the primary bosses, each end of the upper elongate rod connected with the first end of one of the respective pivot arms.

4. An oven appliance as in claim 1, wherein the pair of primary rack gears are attached to the pair of opposing side walls of the oven cavity.

5. An oven appliance as in claim 1, wherein the pair of slides are attached to the pair of opposing side walls of the oven cavity.

6. An oven appliance as in claim 1, wherein the oven cavity defines a transverse direction, and wherein the rack is slidable along the transverse direction relative to the latch mechanism.

7. An oven appliance as in claim 1, further comprising:

a pair of secondary rack gears, each secondary rack gear positioned adjacent one of the opposing side walls and near the opening of the oven cavity, each secondary rack gear comprising a plurality of gear teeth arranged along the vertical direction; and a pair of secondary bosses, each secondary boss connected with the latch mechanism and configured for selective movement between a first position where each secondary boss engages the plurality of teeth of one of the secondary rack gears to fix the position of the latch mechanism along the vertical direction, and a second position where each secondary boss is disengaged from one of the secondary rack gears so that the latch mechanism may be moved to another selected position along the vertical direction.

8. An oven appliance as in claim 7, wherein the oven cavity defines a transverse direction, and wherein the latch mechanism further comprises:

a pair of struts, each extending along a transverse direction to engage at least one of the secondary bosses.

9. An oven appliance as in claim 8, wherein each strut includes a U-shaped portion, and wherein the latch mechanism further comprises a pair of springs, each of said springs urging at least one of the secondary bosses against the U-shaped portion of at least one of the pair of struts.

10. An oven appliance as in claim 9, further comprising a connecting rod extending along the lateral direction between a pair of ends that define the secondary bosses.

11. An appliance defining lateral, vertical, and transverse directions, the appliance comprising:

a cabinet defining a cavity and including a pair of opposing side walls and a rear wall extending laterally between the opposing side walls;

a rack located in the cavity of the cabinet;

a rack support assembly for positioning the rack along the vertical direction in the cavity, wherein along each of the opposing side walls the rack support assembly comprises a rack gear comprising a plurality of teeth, the rack gear positioned adjacent to one of the opposing side walls and extending along the vertical direction;

a track extending along the vertical direction and parallel to the rack gear;

a positioning car carried on the track, the positioning car comprising a pivot arm having a first end and a second end;

a primary boss extending from the first end of the pivot arm, wherein the pivot arm is rotatable about the second end between a first position where the primary boss rests upon the plurality of teeth of one of the rack gears so as to fix the vertical position of the rack support assembly, and a second position where the primary boss is removed from the plurality of teeth of one of the rack gears so that the rack support assembly can be selectively moved along the vertical direction; and, a latch mechanism connected with the pivot arm, the rack supported upon the latch mechanism.

12. An appliance as in claim 11, wherein along each of the opposing side walls the rack support assembly further comprises:

a runner slidably received into the track and configured for movement relative to the track along the vertical direction, wherein the positioning car is attached to the runner.

13. An appliance as in claim 11, wherein the pivot arm comprises a first end and a second end spaced apart from each other along the pivot arm, and wherein the latch mechanism further comprises:

a lower elongate rod extending along the lateral direction between a pair of ends, wherein each end is inserted through one of the positioning cars and is connected to one of the pivot arms, each pivot arm being pivotable about its second end.

14. An appliance as in claim 13, wherein the latch mechanism further comprises:

an upper elongate rod extending along the lateral direction between a pair of ends with each end of the upper elongate rod defining one of the primary bosses, each end of the upper elongate rod connected with the first end of one of the respective pivot arms.

15. An appliance as in claim 11, wherein the rack is slidable along the transverse direction relative to the latch mechanism.

16. An appliance as in claim 11, further comprising:

a pair of secondary rack gears, each secondary rack gear positioned adjacent one of the opposing side walls and near the opening of the cavity, each secondary rack gear comprising a plurality of gear teeth arranged along the vertical direction; and a pair of secondary bosses, each secondary boss connected with the latch mechanism and configured for selective movement between a first position where each secondary boss engages the plurality of teeth of one of the secondary rack gears to fix the position of the latch mechanism along the vertical direction, and a second position where each secondary boss is disengaged from one of the secondary rack gears so that the latch mechanism may be moved to another selected position along the vertical direction.

17. An appliance as in claim 16, wherein the latch mechanism further comprises:

a pair of struts, each extending along a transverse direction to engage at least one of the secondary bosses.

18. An oven appliance as in claim 17, wherein each strut includes a U-shaped portion, and wherein the latch mechanism further comprises a pair of springs, each of said springs urging at least one of the secondary bosses against the U-shaped portion of at least one of the pair of struts.

* * * * *